US005079902A

United States Patent [19]

Seko et al.

[11] Patent Number: 5,079,902

[45] Date of Patent: Jan. 14, 1992

[54] PACKAGING METHOD AND APPARATUS

[75] Inventors: Kiyoshi Seko; Masato Hatano; Shigeki Suzuki, all of Nagoya, Japan

[73] Assignee: Fuji Machinery Company Ltd., Aichi, Japan

[21] Appl. No.: 420,987

[22] Filed: Oct. 13, 1989

[30] Foreign Application Priority Data

Dec. 28, 1988 [JP] Japan ..... 63-335157

[51] Int. Cl.[5] ..... B65B 51/30; B65B 51/16; B65B 9/20

[52] U.S. Cl. ..... 53/450; 53/479; 53/550; 53/553; 53/374.4; 53/374.5; 53/375.9; 53/376.2

[58] Field of Search ..... 53/450, 550, 373, 55, 53/66, 477, 553, 75, 76, 374.4, 374.5, 375.9, 376.2

[56] References Cited

U.S. PATENT DOCUMENTS

| | | | |
|---|---|---|---|
| 3,438,173 | 4/1969 | Omori | 53/373 X |
| 3,546,849 | 12/1970 | Zimmerman | 53/373 |
| 4,525,977 | 7/1985 | Matt | 53/550 X |
| 4,549,386 | 10/1985 | Wilson | 53/550 X |
| 4,574,566 | 3/1986 | Eaves et al. | 53/550 X |
| 4,712,357 | 12/1987 | Crawford et al. | 53/550 X |
| 4,722,168 | 2/1988 | Heaney | 53/550 X |
| 4,726,168 | 2/1988 | Seko | 53/550 X |
| 4,876,842 | 10/1989 | Ausnit | 53/550 X |

*Primary Examiner*—Horace M. Culver

*Attorney, Agent, or Firm*—Schwartz & Weinrieb

[57] ABSTRACT

A packaging method, and an apparatus for carrying out the method, comprises the operation of a conveyor for conveying articles to be packaged, the supply of a packaging film to be formed into a tubular-shaped package for enclosing or packaging the articles to be packaged, and the provision of end sealing mechanisms for sealing the ends of the tubular packages. A central processing unit contains data concerning the cut pitch for cutting the film, the size of the packaged articles, and the like, and accordingly, in order to effect a tight packaging of the articles, whereby the length of the article packages is effectively reduced as compared with conventional packages, whereby less packaging film is utilized, or in other words, the economic usage of the packaging film is maximized, the rotational speed of the end sealing mechanism is varied in a non-uniform manner such that when the end sealer elements of the end sealing mechansim are disposed at predetermined angular positions away from their mutually opposed or engaged position, the rotary speed of the end sealer elements is greater than the film feeding speed, while when the end sealing elements are disposed at predetermined angular positions within the vicinity of their opposed or engaged sealing position, and including their substantially opposed or engaged sealing position, the rotational speed of the end sealing elements is substantially equal to that of the film feeding speed.

16 Claims, 6 Drawing Sheets

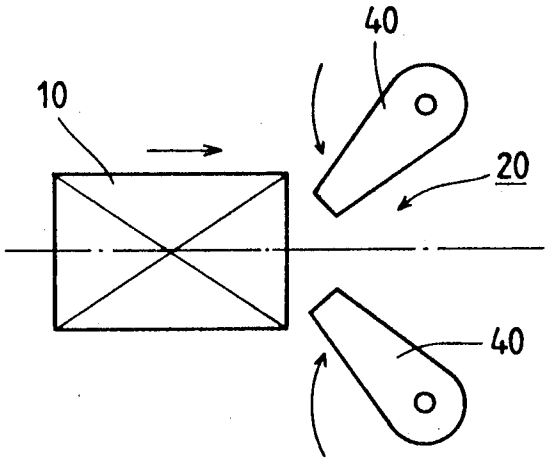
FIG. 4 (a)
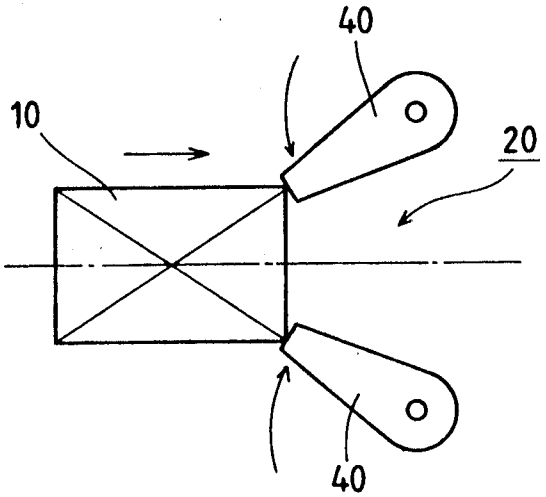
FIG. 4 PRIOR ART (b)
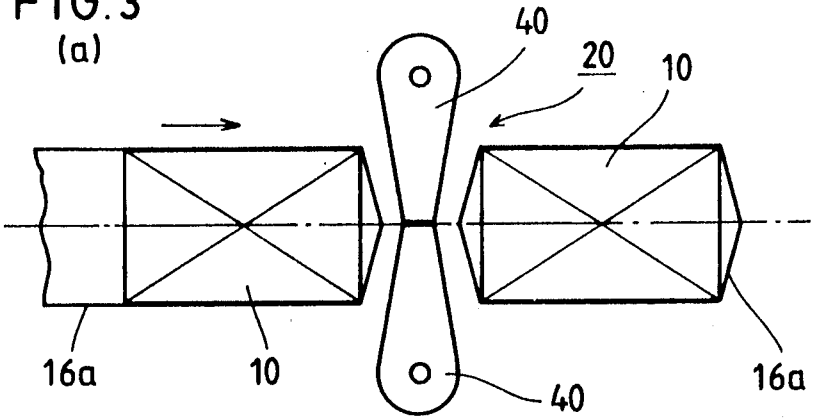
FIG. 3 (a)
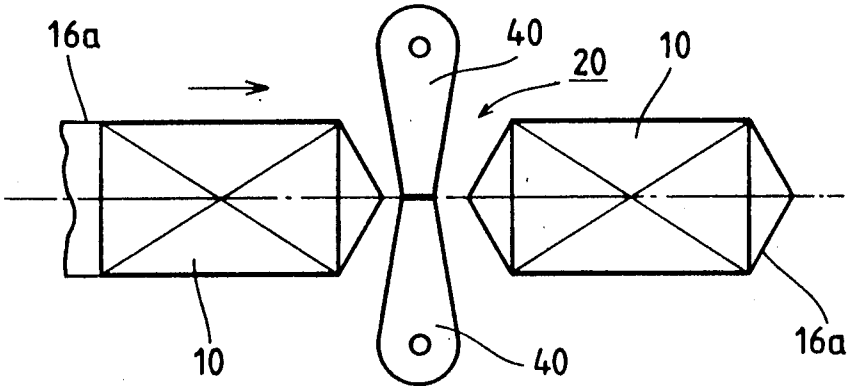
FIG. 3 PRIOR ART (b)

PACKAGING METHOD AND APPARATUS

FIELD OF THE INVENTION

This invention relates to a novel packaging method and a packaging apparatus for a packaging machine in which a film having been shaped into a tubular form and packed with packaging articles is end-sealed, as the film is fed, by means of a pair of sealers disposed so as to oppose each other upon the upper and lower sides of the film feeding route, wherein the actual package length can be minimized so as to achieve tight packaging of the packaging articles within the film.

BACKGROUND OF THE INVENTION

There have been widely used packaging machines in which packaging articles of various shapes are successively inserted within a packaging film having been shaped into a tubular form, and the longitudinal end portions of the tubular film are subjected to lengthwise sealing of the overlapping faces, followed by crosswise sealing and cutting of the tubular packaging film upon both sides or ends of each packaging article, so as to produce a number of pillow type packages. In this connection, the means for sealing the tubular packaging film in the crosswise direction (hereinafter referred to as "end sealing") is generally composed of a pair of sealers (each equipped with a cutting knife) which are disposed so as to oppose each other upon the upper and lower sides of the film feeding route.

Within a lateral pillow package making machine within which packaging articles are fed horizontally, a film is continuously fed, so that when the film is sealed and cut by means of a pair of sealers which engage the film, the movement of the sealers must be synchronized with the feeding speed of the film. Accordingly, within a rotary end sealing mechanism usually employed within such lateral pillow package making machines, nonuniform motion is imparted to the rotation of the pair of sealers so as to allow the peripheral rotational speed of the sealers during the sealing and cutting operation to be synchronized with the film feeding speed.

Within the conventional lateral pillow package making machines, the sealers for the crosswise sealing operation are adapted to be driven through means of a mechanical transmission system. Accordingly, while the rotational speed of the sealers can be mechanically controlled, it cannot be varied substantially since the variable speed range is extremely limited as shown within the graph of FIG. 6. Thus, when the height of the packaging article 10 is great, as shown, for example, in FIG. 4(*b*), the sealers 40 sometimes interfere with the packaging article 10 (and the film), or vice versa, that is, sometimes one of the packages interferes with the operation or movement of the end sealers. If a package is wrapped so as to have a tightly applied film 16 by controlling the packaging apparatus in such a manner that the package length may is effectively shortened, it provides a good appearance for the finished package and is also economical since the film length required for one package can be reduced. However, when the height of the packaging article is substantial, the apparatus or system is not practically operative, in that such tight packaging cannot be achieved since the tips of the sealers interfere with the rear end of the preceding packaging article or the fore end of the following packaging article, during their sealing and cutting operations.

OBJECT OF THE INVENTION

This invention has been proposed with a view to suitably solve the above problem and is directed toward providing a means which can reduce the actual package length without resulting in any interference between the sealers and the packaging articles.

SUMMARY OF THE INVENTION

In order to overcome the above problems and attain the intended object, one aspect of this invention is to provide a packaging method, which comprises the steps of:

when a film having been shaped into a tubular form and packed with packaging articles is end-sealed, as the film is fed, by use of a pair of sealers oppositely disposed with respect to each other upon the upper and lower sides of the film feeding route, the rotational speed of the pair of rotating sealers relative to the timing of the feeding of the packaging articles corresponding to the cut pitch for cutting the film and the height of the packaging articles is varied within the angular range of at least ±90° from the point of engagement of the pair of sealers so that the sealers may not interfere with the packaging articles whereby the position of the sealers is suitably and more particularly controlled;

setting the peripheral rotational speed of the sealers such that it may always be higher than the film feeding speed when the end sealers are not in sealing engagement with each other; and controlling the peripheral rotational speed of the sealers such that it may correspond to the film feeding speed when the pair of sealers are in sealing engagement with each other.

In order to likewise suitably attain the intended object, another aspect of this invention is to provide a packaging apparatus comprising:

a conveyor for feeding packaging articles;

a rotary encoder which monitors the present location of the packaging articles being fed so as to generate feed timing signals;

an end seal mechanism which drives a pair of sealers so as to effect crosswise sealing of a film having been shaped into a tubular form;

a central processing unit which processes input data such as, for example, the cut pitch for cutting the film, the height of the packaging articles, and the like, so as to determine the motion curve of the pair of sealers, the timing of the sealer engagement and the speed of feeding the film, and a nonuniform rotational control circuit which commands predetermined nonuniform rotation to the end seal mechanism in response to commands from the central processing unit;

wherein the rotational speed of the pair of rotating sealers is varied relative to the timing of the feeding of the packaging articles corresponding to the cut pitch for cutting the film and the height of the packaging articles within the angular range of at least ±90° from the point of engagement of the pair of sealers so that the sealers may not interfere with the packaging articles whereby the position of the sealers is controlled; and more particularly, the peripheral rotation speed of the sealers is set such that it may always be higher than the film feeding speed when the sealers are not in sealing engagement with each other, and the rotational peripheral speed of the sealers is controlled such that it may correspond to the film feeding speed when the pair of sealers are in sealing engagement with each other.

As has been described above, according to the packaging method of this invention, the actual package length can be set to a small value and packages having a tightly applied film thereon can be obtained regardless of the height of the packaging article, so that the amount of film can be saved, contributing greatly to a reduction in the utilized costs, and also packages having a good appearance can be obtained. It should be noted that, while in the embodiment shown in the drawings, the rotary sealing mechanism will be described as comprising sealers for an end seal mechanism, another sealing mechanism in which sealers are moved apart vertically from each other along arcuate routes after sealing and cutting operations, motion and, move horizontally can also be employed. While the embodiment will be described wherein they also with reference to a bag making/packing/sealing packaging machine, the method and apparatus according to this invention can be suitably employed within other types of packaging machines.

BRIEF DESCRIPTION OF THE DRAWINGS

Various other objects, features, and attendant advantages of the present invention will become better appreciated from the following detailed description when considered in connection with the accompanying drawings, in which like reference characters designate like or corresponding parts throughout the several views, and wherein:

FIG. 3(*a*) schematically illustrates the final state of crosswise sealing the operation according to the method of the this invention.

FIG. 3(*b*) schematically illustrates the final state of the crosswise sealing operation according to a conventional method.

FIG. 4(*a*) schematically illustrates the state wherein the crosswise sealing operation is being conducted according to the method of this invention.

FIG. 4(*b*) schematically illustrates the state wherein the crosswise sealing operation is being conducted according to the conventional method.

DETAILED DESCRIPTION OF THE INVENTION

Figure 2:
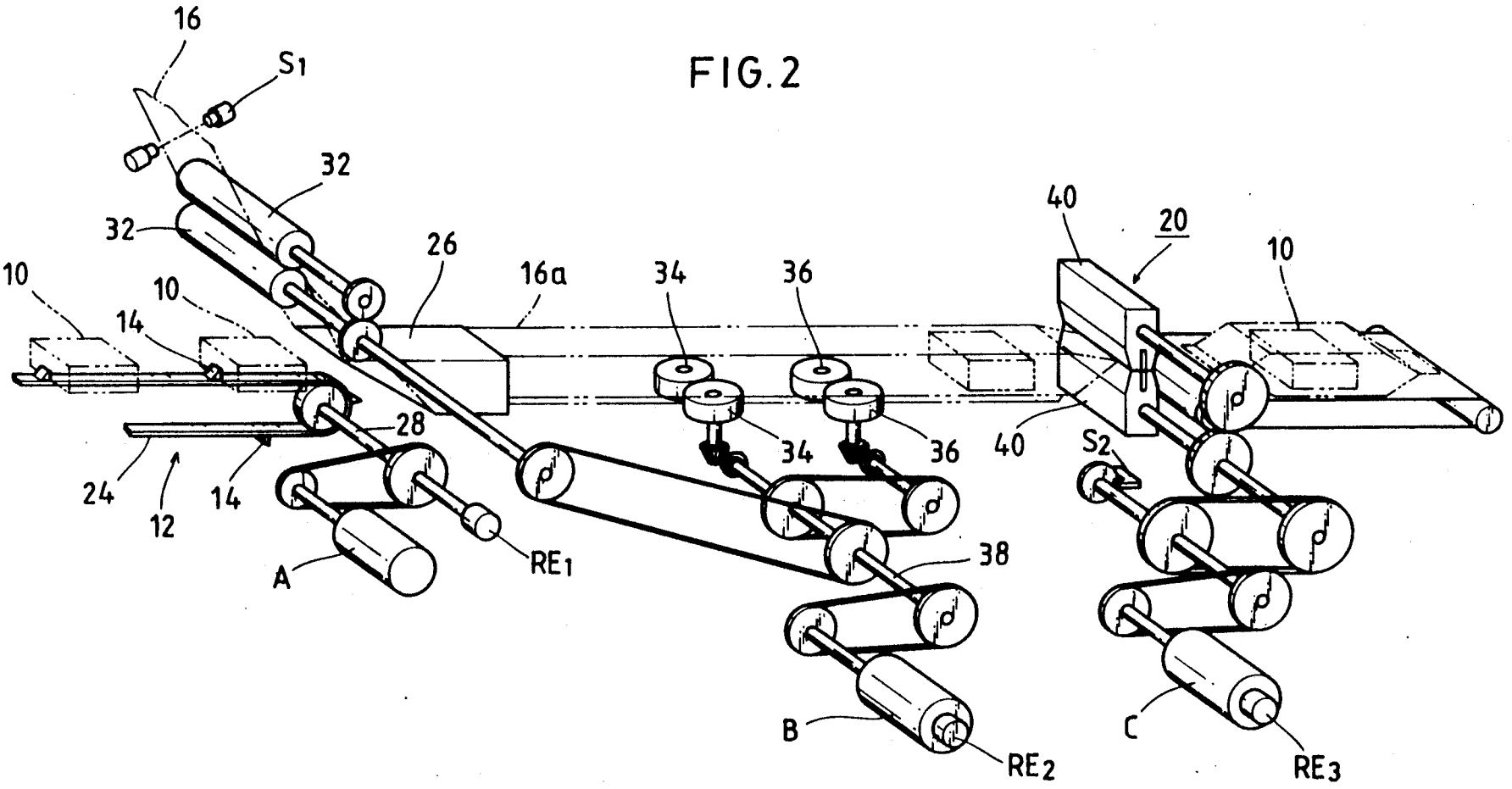
FIG. 2 is a perspective view of a packaging machine in connection with which the present invention can be suitably practiced.
Figure 6:
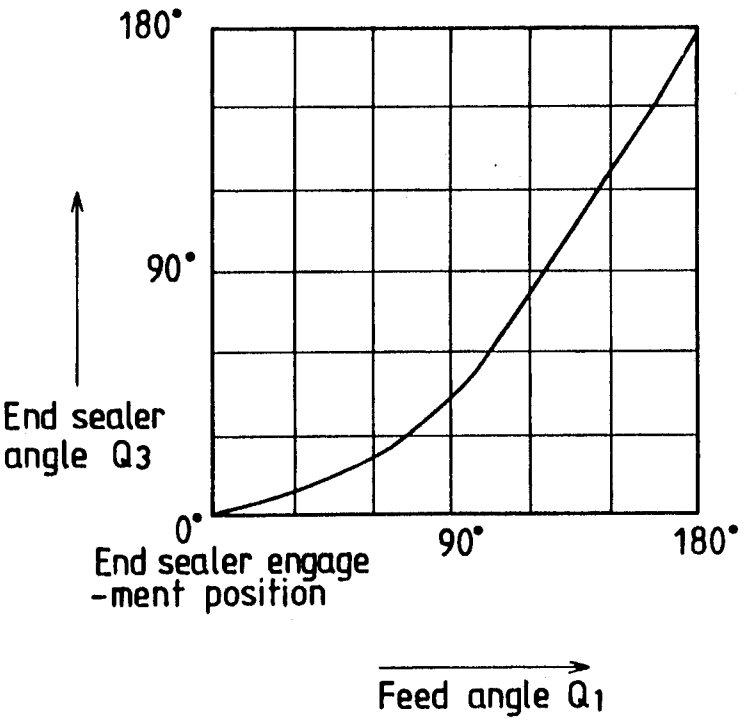
FIG. 6 PRIOR ART
FIG. 6 is a graph showing a position control curve for the sealers of the conventional end seal mechanism.

Next, the packaging method according to this invention will be described and correlated along with the apparatus by means of which the method of this invention is practiced by way of the preferred embodiment illustrated within the attached drawings. FIG. 2 schematically shows a perspective view of an exemplary bag making/packing/sealing packaging machine by means of which the present method can be effected. This packaging machine is equipped with a motor A which is intended for driving a conveyor 12 for feeding packaging articles 10 in a serial manner; a rotary encoder $RE_1$ which monitors the feeding position of each packaging article 10 which is fed in the downstream direction by means of attachments 14 disposed upon the conveyor 12 with a predetermined interval therebetween and generates a zero feed position signal; a servo motor B which is intended for driving rolls 32 for delivering a film 16; and a servo motor C which is intended for driving an end seal mechanism 20.

Figure 1:
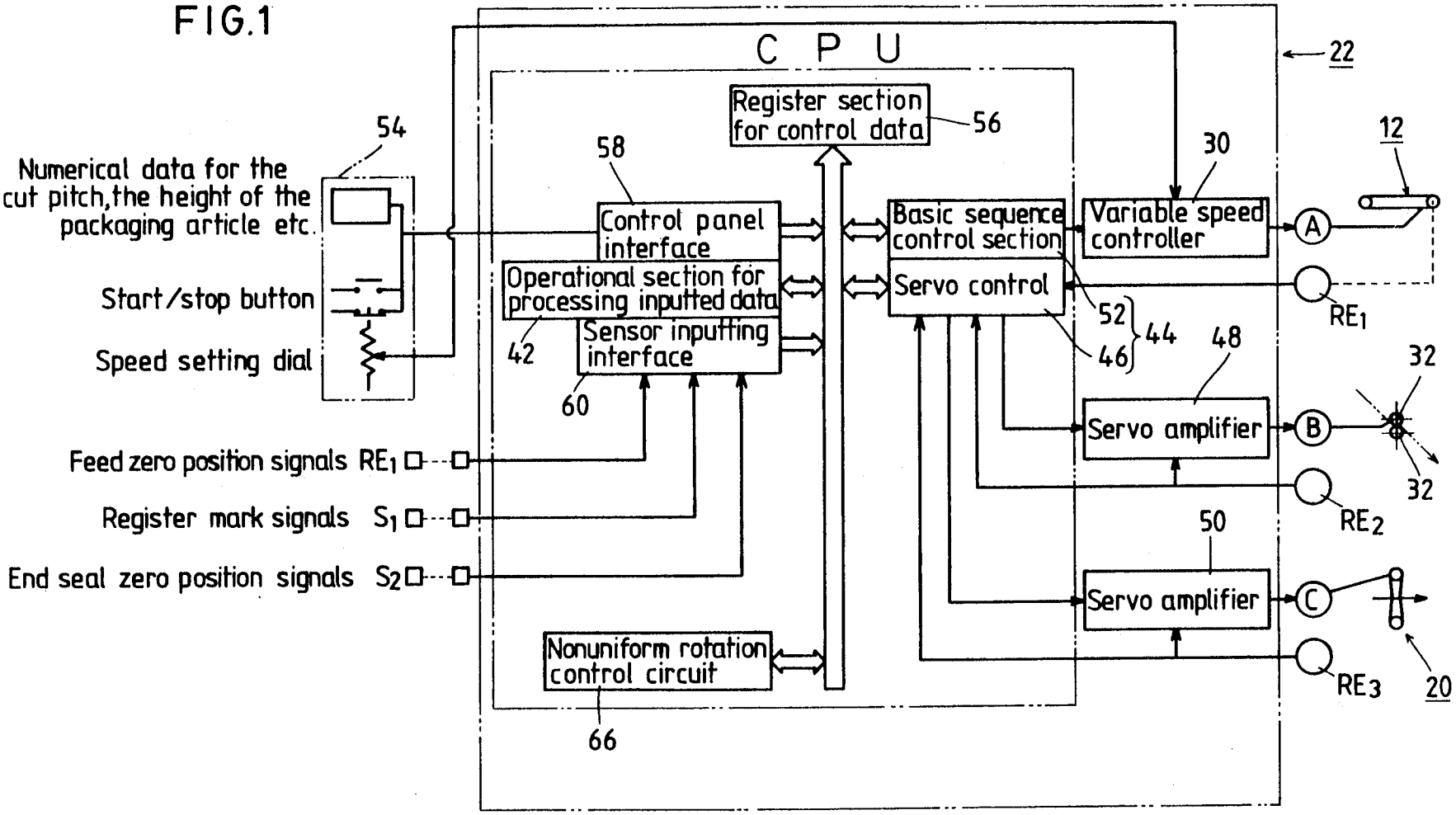
FIG. 1 is a block diagram of the control circuit for practicing the packaging method developed according to this invention.

Furthermore, as shown in FIG. 1, the above packaging machine is also equipped with a control circuit 22 which processes various data including the zero position signal which refers to the position of feeding out each packaging article 10, the cut pitch for cutting the film, or the like, to be generated from the rotary encoder $RE_1$, whereupon receipt of such inputted data, the servo motor B for feeding the film 16 and the servo motor C for driving the end seal mechanism 20 are designed to be controlled respectively based upon the control signals obtained after processing the data in this control circuit 22.

The conveyor 12 is provided with positioning attachments 14 disposed upon an endless chain 24 with a predetermined pitch, defined therebetween so that the packaging articles 10 may be pushed forwardly unit by unit with a predetermined interval by the respective attachment 14 so as to respectively feed them into a downstream bag making device 26 successively. This conveyor 12 is driven by means of the motor A and a power transmission mechanism comprising a timing belt and pulleys disposed upon the illustrated drive shaft 28. The motor A is, for example, an alternating current induction motor, and variable speed control thereof is performed by means of a variable speed controller 30 such as, for example, an inverter as shown in FIG. 1.

The rotary encoder $RE_1$ is provided upon the drive shaft 28 to continually monitor the position of the attachments 14 disposed upon the feeding conveyor 12, that is, the position of the packaging articles 10 being fed into the downstream bag making device 26. The feed zero position signals generated from the rotary encoder $RE_1$ for indicating the position of the fed packaging articles 10 are inputted into the control circuit 22 to be described later.

The film 16 delivered from a web roll (not shown) is held between the pair of delivering rolls 32 and is outwardly fed toward the bag making device 26 disposed downstream of the feeding conveyor 12. The film 16 passed through the bag making device 26 and shaped into a tubular bag 16*a* is fed downstream with the overlapping edges of the longitudinal end portions being held between a pair of feeding rolls 34 and is simultaneously subjected to center sealing by means of a pair of sealing rolls 36. The pair of delivering rolls 32 are driven by means of the servo motor B and a power transmission system comprising timing belts and pulleys as illustrated in the drawing.

The power from the servo motor B is further diverged by means of a drive shaft 38 such that the pairs of feeding rolls 34 and sealing rolls 36 may be synchronously driven. The revolution of the servo motor B is continually detected by means of a rotary encoder $RE_2$, and the number of revelations is fed back to the control circuit 22 so as to achieve servo control of the servo motor B. In this connection, register marks (not shown) are printed along the longitudinal end portion of the film 16 with a predetermined interval therebetween, which are read and detected by means of a sensor $S_1$ comprising photoelectric elements as shown in FIG. 2.

Sealers 40 of the end seal mechanism 20 are rotationally driven by means of the servo motor C and a belt transmission system, and the rotation of the servo motor C is also servo-controlled by means of a rotary encoder $RE_3$. In connection with the type of sealers 40 that may be employed within the system, besides the illustrated rotary sealing mechanism, a sealing mechanism of the type in which sealers move horizontally and synchronously toward the direction of feeding the tubular bag 16*a*, and after completion of the sealing and cutting operations, they are moved apart vertically from each other along arcuate routes so as to also move horizontally can also be efficiently utilized.

In connection with a rotary system within which the rotary sealers 40 are included, an end seal zero position sensor $S_2$ is provided, so that, when a register mark of the tubular bag 16*a* passes between the detection surfaces of the photoelectric electric sensor $S_1$ before generation of the zero feed position signal (standard signal) and with respect to the end seal mechanism to be detected by means of the zero position sensor $S_2$, the sensor $S_2$ may detect the time lag so as to issue a deceleration command to the servo motor B by means of the control circuit 22; on the contrary, when the register mark passes between the detection surfaces of the photoelectric sensor $S_1$ after generation of the standard signal, the sensor $S_2$ may detect the time lag so as to issue an acceleration command to the servo motor B so as to effect positioning of the tubular bag as controlled by means of the printed register mark.

The control circuit 22 shown in FIG. 1 has a built-in central processing unit (CPU) containing an operational section 42 which functionally performs operational processing of inputted data, a motor control section 44 which controls the motor A, servo motor B and servo motor C, and a register section 56 in which control data is registered. A control panel 54 has keys for inputting various data, a button for commanding start/stop of the packaging machine, a speed setting dial, and the like and the keyed-in data being recorded at the register section 56 by means of a control panel interface 58.

Now referring to the data which is to be inputted at the control panel 54, names of several tens of different packaging articles and their respective packaging data can be registered within the built-in memory in the main body. If any changes in the specifications of the packaging article should occur, numerical data for the cut pitch which depends upon the cut length of the film 16 for one package, the height of the packaging article 10 and the set value of the heater temperature are inputted by means of the operational members such as, for example, the keys. Furthermore, (1) the zero feed position mark signals from the rotary encoder $RE_1$ which monitor the position of the attachments 14; (2) the register mark signals from the photoelectric sensor $S_1$ which reads and detects the register marks printed upon the film 16 and (3) the end seal zero position signals from the end seal zero position sensor $S_2$ which detects the rotation of the sealers 40 are introduced by means of the sensor inputting interface 60 to the register section 56 a digital input data.

The speed of the motor A is variably controlled by a variable speed controller 30 typified by means of an inverter, and to this variable speed controller 30 there is directly given a speed command for the motor A from the speed control dial. On the other hand, the servo motor B which performs delivery of the film 16 and the servo motor C which effects end sealing: of the tubular bag 16*a* are adapted to be servo-controlled by means of a servo amplifier 48 and a servo amplifier 50, respectively.

The zero feed position signals from the rotary encoder $RE_1$ are inputted into the servo control section 46 of the motor control section 44 so as to correlate the present position of the attachments 14 with respect to the servo motor B and servo mo&or C. Likewise, the rotary signals from the rotary encoder $RE_2$ which detects the number of revolutions of the servo motor B are inputted into the servo control section 46 and the servo amplifier 48. Furthermore, the rotary signals from the rotary encoder $RE_3$ which detects the number of revolutions of the servo motor C are also inputted into the servo control section 46 and the servo amplifier 50.

Incidentally, a basic sequence control section 52 is designed to process various input conditions so as to send signals for starting and stopping the motor A to the variable speed controller 30 and also to detect any abnormality so as to stop the function of the variable speed controller 30.

The central processing unit (CPU) is designed to process inputted data such as the cut pitch for cutting the film 16 and the height of the packaging article 10 so as to determine the motion curve of the pair of sealers 40 and the time period during which the sealers 40 engage with each other. The nonuniform rotation control circuit shown with the reference number 66 directs the end seal mechanism 20 to perform a predetermined nonuniform rotational movement upon receipt of the command from the central processing unit.

BASIC MOTION OF THE PACKAGING MACHINE

To describe first the basic motions of this packaging machine, packaging data including the cut pitch for cutting the film 16, the height of the packaging article 10 and the sealing temperature are inputted by means of the operational members, such as, for example, the keys, provided on the control panel 54, prior to starting of the machine, and this data is registered within the memory of the register section 56 by means of the control panel interface 58. Furthermore, speed command is preliminarily given to the variable speed controller 30 by means of the speed setting dial so as to predetermine the revolutionary speed of the motor A.

After completion of the setting of the synchronous operation, the machine is started by pressing a start button not shown, whereby the motor A, servo motor B and servo motor C start to rotate alltogether. The feeding conveyor 12 is driven by means of the motor A, and the packaging articles 10 are pushed forwardly as individual units by means of the respective attachment 14 disposed upon the conveyor 12. Aero feed position signals from the rotary encoder $RE_1$ are inputted into the servo control section 46 so as to indicate the position of each attachment 14 forwarding its respective packaging article 10. The rotary signals from the rotary encoder $RE_2$ operatively associated with the servo motor B are inputted into the servo control section 46 and the servo amplifier 48, and the rotary signals from the rotary encoder $RE_3$ operatively associated with the servo motor C are inputted into the servo motor control section 46 and the servo amplifier 50.

The packaging data including the cut for cutting the film 16, the height of the packaging article 10 and the sealing temperature registered within the memory of the register section 56 are operationally processed within the operational section 42 so as to generate commands to the control section 44. At the servo control section 46, the rotary operation of the servo motors B and C are synchronously controlled based upon the data for the positions of the attachments 14 in terms of the zero feed position signals from the rotary encoder $RE_1$. Thus, in accordance with the time for feeding each packaging article 10 into its respective tubular bag 16*a*, delivery of the film 16 by means of the servo motor B and the nonuniform rotation of the sealers 40 by means of the servo motor C are efficiently achieved. Incidentally, any change in the cut pitch for cutting the film 16, or the height of the packaging article 10 and/or the sealing temperature in accordance with a package order change can be speedily accommodated by modifying the data by means of the operational members such as, for example, the keys upon the control panel 54.

MOTION DEVELOPMENT IN A PREFERRED EMBODIMENT

Next, the motion development within a preferred embodiment constructed according to the present packaging method will be described. According to the embodiment, the present positions of the sealers 40 are controlled by varying the rotational speed thereof relative to the timing of the feeding of the packaging articles 10 such that the sealers 40 will not interfere with the packaging articles 10 when the sealers 40 are disposed at positions which are at least within the range of ±45° with respect to the point at which the sealers 40 are rotationally engaged with each other, that is the sealers 40 are rotated such that their peripheral rotational speed is always greater than the feeding speed of the packaging article 10. To achieve this, the data for the cut pitch for cutting the film 16 and the height of the packaging article 10 are preliminarily inputted at the control panel 54, since such data significantly affects such operation. When the pair of sealers 40 are to be engaged with each other, the peripheral rotational speed of the sealers 40 is controlled so as to correspond to the feeding speed of the film 16.

Figure 5:
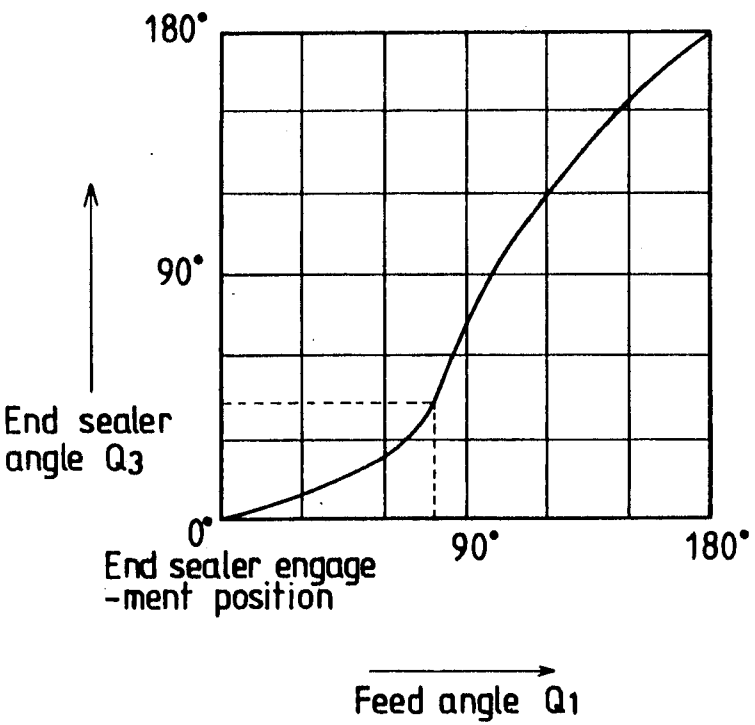
FIG. 5 is a graph showing a position control curve for the sealers of the end seal mechanism according to this invention.
Figure 9:
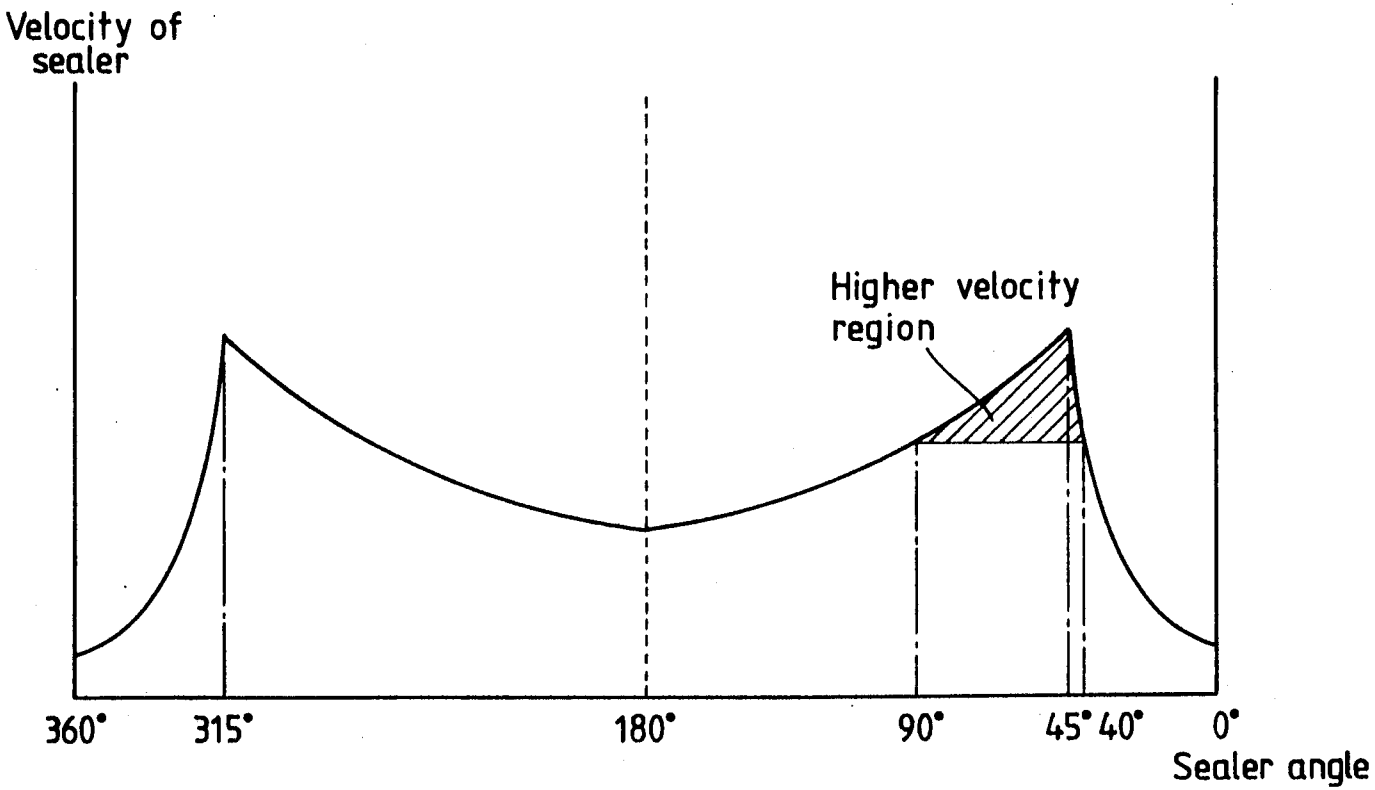
FIG. 9 is a graph showing the relationship between the velocity of each end sealer as a function of the rotary sealer angle.

These controlled operations are achieved by generating a predetermined nonuniform rotation signal from the nonuniform rotation control circuit 66 to the end seal mechanism 20 upon receipt of such command from the central processing unit. In this context, the speed control curve for the motor C for driving the end seal mechanism 20, which can be determined according to the following functional expression, is as shown in FIG. 5. In addition, as seen in FIG. 9, taken in conjunction with the graph and speed control curve of FIG. 5, there is shown a graphical representation of the velocity of each end sealer as a function of the rotary sealer angle. In particular, when the rotary sealer angle is 0° (360°), the velocity of each end sealer corresponds to that of the film feeding speed, whereas when the rotary sealer angle is ±45°, or in other words 45° before or after the end sealer engagement position as shown in FIG. 3(*a*), and as shown in FIG. 4(*a*) or FIG. 7, that is, at 45° or 315° with respect to the end sealer engagement position, the velocity of each end sealer is at a maximum. It is further appreciated that within the range of 0° to 45°, the end sealers are non-uniformly accelerated from the velocity at the end sealer engagement position to the maximum velocity at the 45° position, while when each end sealer is disposed within the angular rotational range of 45° to 180°, that is, the position diametrically opposite the end sealer engagement position, the velocity of each end sealer is non-uniformly decelerated. The velocity of each end sealer within the range of 180° to 360° (0°) is then, in effect, the mirror image of the velocity profile within the angular rotational range of 0° to 180°, that is, when the end sealers are within the angular rotational range of 180° to 315°, the velocity of the same is non-uniformly accelerated up to the maximum velocity at the position corresponding to 315°, and when each end sealer is within the angular rotational range of 315° to 360° (0°), the velocity of the end sealers is non-uniformly decelerated down to the velocity corresponding to the film feed speed. In this calculation, the sealing mechanism is assumed to be of the illustrated rotational type.

Z: ratio of cut pitch to circumferential length drawn by the tip of the end sealer G: function for speed rate P: film cut pitch H: height of the packaging article D: rotation diameter of the end sealing mechanism (distance from center of the rotary shaft to the tip of end sealer×2)

$Q_{11}$: present angle of the rotary encoder $RE_1$ for the conveyor when the end sealer is at an angle of 45° (present location of packaging article being fed)

f,f': function for the present location of packaging article being fed relative to the end sealer angle $Q_1$: feed angle F: function for the end sealer angle relative to the present location of packaging article being fed $Q_3$: angle of the end sealer relative to the present location of packaging article being fed $W_{13}$: peripheral speed of the end sealer at the point of inflection $Z=G(P, H, D)$ $Q_{11}=f(Z)$ $Q_3=F(Q_1, Z)$ . . . timing curve until the zone of ±45° from the end sealer engagement position $Q_3=f'(Q_1, W_{13}, Q_{11})$ . . . timing curve after the zone of ±45° from the end sealer engagement position While this embodiment describes the controlled operation within an angular sector of at least ±45° from the point of sealer engagement, such control can be practiced within an angular sector of at least ±90° from the point of sealer engagement.

Figure 8:
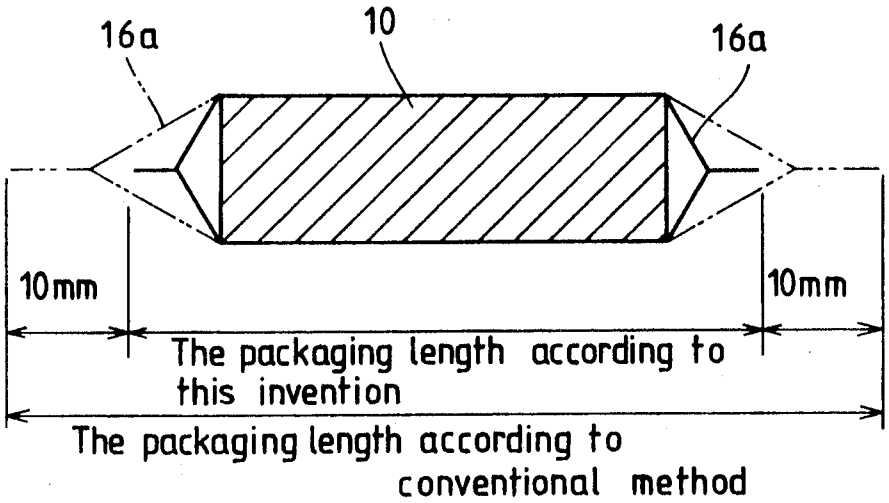
FIG. 8 schematically illustrates the state, after completion of the sealing and cutting operation, wherein the actual package length is greatly reduced as compared with that according to the conventional packaging method.
Figure 7:
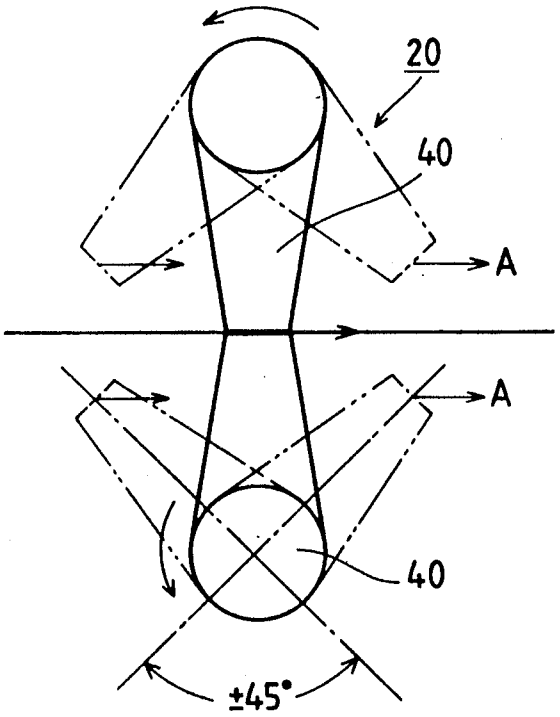
FIG. 7 schematically illustrates the horizontal movement of the tips of the sealers as a result of the rotational motion of the pair of sealers, wherein the direction of the movement is indicated by means of arrows A.

As shown in FIG. 4(*a*), according to this invention, the rotational speed of the rotating sealers 40 can be predetermined such that they will not interfere with the packaging article 10, or conversely, the packaging article will not interfere with the sealers 40, by varying the rotational speed of the sealers 40 at the time when the packaging article 10 reaches the end sealing position so as to control the position of the sealers, whereby the peripheral rotational speed of the sealers is always greater than the feeding speed of the film when the sealers 40 are not opposed to or engaged with each other, as also shown by means of the dotted lines of FIG. 7, whereas the speed of the transverse movements (shown by means of the Arrow A in FIG. 7) of the tips of the pair of sealers 40 is controlled to correspond to the feeding speed of the film 10 when the sealers 40 are substantially opposed and engaged with each other so as to perform a sealing operation. After completion of the sealing and cutting operations, a tightly packaged article having a reduced package length as shown in FIG. 3(*a*) can be obtained. The actual package length of the final article is, as shown in FIG. 8, effectively reduced 10 mm at each cut end (20 mm in total) per one package length regardless of the height of the packaging article 10.

Obviously, many modifications and variations of the present invention are possible in light of the above teachings. It is therefore to be understood that within the scope of the appended claims, the present invention can be practiced otherwise than as specifically described herein.

What is claimed is:

1. A packaging method for forming packaged articles, comprising the steps of:

conveying a plurality of articles to be packaged along a conveyor at predetermined intervals defined therebetween;

conveying a packaging film for enclosing said articles to be packaged;

forming said packaging film into a tubular package and conveying said articles to be packaged into said tubular package;

predetermining the height of said articles to be packaged and the cut pitch for cutting said tubular package so as to properly form individual packages containing said articles to be packaged;

providing an end sealer mechanism, comprising end sealing elements to be disposed at an end sealing engagement position, for sealing and cutting said tubular package into said individual packages containing said articles to be packaged in accordance with said predetermined height of said articles and said cut pitch of said tubular packaging film; and controlling the rotational speed of said end sealing elements in a non-uniform manner such that when said end sealing elements are disposed at angular positions, with respect to said end sealing engagement position, which are less than a predetermined angular extent considered in a positive or negative manner with respect to said end sealing engagement position, the rotational speed of said end sealing elements will correspond with said conveying speed of said packaging film when said end sealing elements are in contact with each other at said end sealing engagement position and will be non-uniformly accelerated or decelerated with respect to said predetermined angular extent so as to achieve maximum velocity at said predetermined angular extent, while when said end sealing elements are disposed at angular positions, with respect to said end sealing engagement position, which are equal to or greater than said predetermined angular extent, the rotational speed of said end sealing elements will always be greater than the conveying speed of said packaging film and will be non-uniformly decelerated or accelerated with respect to said predetermined angular extent so as to achieve a minimum velocity at an angular position opposite said end sealing engagement position.

2. The method as set forth in claim 1, wherein:

said predetermined angular extent comprises ±45° with respect to said end sealing engagement position.

3. The method as set forth in claim 1, wherein:

said predetermined angular extend comprises at least ±45° with respect to said end sealing engagement position.

4. The method as set forth in claim 3, wherein:

said predetermined angular extent comprises ±90° with respect to said end sealing engagement position.

5. The method as set forth in claim 1, wherein:

said predetermined angular extent comprises ±90° with respect to said end sealing engagement position.

6. The method as set forth in claim 1, wherein:

said predetermined angular extent comprises at least ±90° with respect to said end sealing engagement position.

7. The method as set forth in claim 1, wherein:

said predetermined angular extent comprises an angular extent within the range of ±0°-45°.

8. The method as set forth in claim 1, wherein:

said predetermined angular extend comprises an angular extent within the range of ±0°-90°.

9. Apparatus for forming packaged articles, comprising:

means for conveying a plurality of articles to be packaged along a conveyor path at predetermined intervals defined therebetween;

means for conveying a packaging film for enclosing said articles to be packaged;

means for forming said packaging film into a tubular package and conveying said articles to be packaged into said tubular package;

means for predetermining the height of said articles to be packaged and the cut pitch for cutting said tubular package so as to properly form individual packages containing said articles to be packaged;

an end sealer mechanism, comprising end sealing elements to be disposed at an end sealing engagement position, for sealing and cutting said tubular package into said individual packages containing said articles to be packaged in accordance with said predetermined height of said articles to be packaged and said cut pitch of said tubular packaging film; and means for controlling the rotational speed of said end sealing elements in a non-uniform manner such that when said end sealing elements are disposed at angular positions, with respect to said end sealing engagement position, which are less than a predetermined angular extent considered in a positive or negative manner with respect to said end sealing engagement position, the rotational speed of said end sealing elements will correspond with said conveying speed of said packaging film when said end sealing elements are in contact with each other at said end sealing engagement position and will be non-uniformly accelerated or decelerated with respect to said predetermined angular extent so as to achieve maximum velocity at said predetermined angular extent, while when said end sealing elements are disposed at angular positions, with respect to said end sealing engagement position, which are equal to or greater than said predetermined angular extent, the rotational speed of said end sealing elements will always be greater than the conveying speed of said packaging film and will be non-uniformly decelerated or accelerated with respect to said predetermined angular extent so as to achieve a minimum velocity at an angular position opposite said end sealing engagement position.

10. Apparatus as set forth in claim 9, wherein:

said predetermined angular extent comprises ±45° with respect to said end sealing engagement position.

11. Apparatus as set forth in claim 9, wherein:

said predetermined angular extent comprises at least ±45° with respect to said end sealing engagement position.

12. Apparatus as set forth in claim 11, wherein:

said predetermined angular extent comprises ±90° with respect to said end sealing engagement position.

13. Apparatus as set forth in claim 9, wherein:

said predetermined angular extent comprises ±90° with respect to said end sealing engagement position.

14. Apparatus as set forth in claim 9, wherein:

said predetermined angular extent comprises at least ±90° with respect to said end sealing engagement position.

15. Apparatus as set forth in claim 9, wherein:

said predetermined angular extent comprises an angular extent within the range of ±0°–45°.

16. Apparatus as set forth in claim 9, wherein:

said predetermined angular extent comprises an angular extent within the range of ±0°–90°.

* * * * *